US005419170A

United States Patent [19]

Sanders et al.

[11] Patent Number: 5,419,170

[45] Date of Patent: May 30, 1995

[54] GAS CONTROL FOR SUPERPLASTIC FORMING

[75] Inventors: Daniel G. Sanders, Sumner; John R. Fischer, Seattle; Chris J. Takayama, Bellevue, all of Wash.

[73] Assignee: The Boeing Company, Seattle, Wash.

[21] Appl. No.: 138,282

[22] Filed: Oct. 15, 1993

[51] Int. Cl.[6] ..... B21D 26/02

[52] U.S. Cl. ..... 72/60; 72/709; 29/421.1

[58] Field of Search ..... 72/60, 54, 61, 709; 29/421.1

[56] References Cited

U.S. PATENT DOCUMENTS

| | | | |
|---|---|---|---|
| 4,181,000 | 1/1980 | Hamilton et al. | 72/60 |
| 4,233,829 | 11/1980 | Hamilton et al. | 72/38 |
| 4,233,831 | 11/1980 | Hamilton et al. | 72/60 |
| 4,352,280 | 10/1982 | Ghosh | 72/38 |
| 4,375,375 | 3/1983 | Giamei et al. | 148/11.5 |
| 4,489,579 | 12/1984 | Daime et al. | 72/38 |
| 4,658,362 | 4/1987 | Bhatt | 364/472 |
| 4,708,008 | 11/1987 | Yasui et al. | 72/60 |
| 4,811,582 | 3/1989 | Story et al. | 72/16 |
| 4,901,522 | 2/1990 | Ginty et al. | 72/60 |
| 4,951,491 | 8/1990 | Lorenz | 72/60 |
| 5,129,248 | 7/1992 | Yasui | 72/60 |
| 5,309,747 | 5/1994 | Yasui | 72/60 |

FOREIGN PATENT DOCUMENTS

| | | |
|---|---|---|
| 1197021 | 1/1989 | Japan . |
| 576143 | 4/1979 | U.S.S.R. . |

*Primary Examiner*—David Jones
*Attorney, Agent, or Firm*—J. Michael Neary

[57] ABSTRACT

A gas management system for delivering forming gas under a controlled pressure through a first portion of a piping network to a region of a forming die between a die lid and a blank to be formed in a superplastic forming machine includes a gas pressure regulator in the piping network and two control loops. The first control loop has a first pressure transducer communicating with the piping network downstream of the gas pressure regulator and operatively with the gas pressure regulator. The second control loop includes a pulse controller downstream of the first pressure transducer and a second pressure transducer communicating with the piping network downstream of the pulse controller and operatively with the pulse controller. The gas pressure regulator receives signals from a controller to adjust the pressure at which the gas pressure regulator opens to release gas through the pressure regulator. The system delivers inert gas to a superplastic forming die at a predetermined pressure on a predetermined schedule to achieve optimum forming speed and quality.

17 Claims, 10 Drawing Sheets

GAS CONTROL FOR SUPERPLASTIC FORMING

BACKGROUND OF THE INVENTION

This invention relates to a method and apparatus for control of the gas pressure in a superplastic forming apparatus, and more particularly to a gas control system and method of operation for precise control of the forming gas pressure and a method for accurately measuring the strain rate of a metal blank in a superplastic forming apparatus.

Superplastic forming is a metal forming process used within the aerospace industry and elsewhere for manufacturing single sheet detailed parts and multi-sheet built-up structures. The design flexibility that is offered by superplastic forming has resulted in substantial cost savings in the fabrication of the detailed parts and assemblies. In the aircraft industry, additional benefits are in superior quality control, reduce weight savings, and lower part variability.

The superplastic forming process utilizes a phenomenon of certain alloys of metal which, when heated to a certain temperature, are capable of undergoing enormous plastic elongation (or strain) with uniform thinning throughout the full area of the metal blank. The processes normally practiced in industry includes heating a die to the superplastic temperature of the metal alloy and placing the metal blank in the die. A restraining pressure is exerted on the die lid to hold it closed against the forming pressure of the gas which is injected into the die above the metal blank to form it into the die cavity in the die base. After the forming is completed, the gas pressure is relieved, the die is opened and the finished part is removed from the die. This basic process is disclosed in U.S. Pat. No. 3,934,441 to Howard Hamilton, et al.

The basic superplastic forming process has been improved for particular metals and to achieve enhanced capabilities in the last twenty or so years. A process known as back pressure forming has been developed for preventing cavitation in certain aluminum alloys. Cavitation is a phenomenon characteristic of certain alloys, 7475 aluminum in particular, in which micro-voids coalesce and propagate from the middle of the sheet, severely degrading the strength properties of the formed part. By applying back pressure during the forming of a part, the cavitation can be considerably minimized or eliminated altogether. The process of applying back pressure is initiated at the beginning of the forming cycle by ramping the pressure on both sides of the sheet to desired pressure and then increasing the pressure above the sheet to form it into the die cavity. This process is disclosed in U.S. Pat. No. 4,354,369 entitled "Method for Superplastic Forming" issued to Howard Hamilton.

Superplastic forming/diffusion bonding is a process in which a pack of two or more sheets are bonded together by means of a diffusion bond at the point of contact and gas is injected between the sheets of the pack to inflate the pack in a die to take the shape of the cavity of the die. This process is ideal for creating a sandwich panel having two face sheets and internal diagonal supporting structure to couple the two sheets in a strong and lightweight integral structure. Superplastic forming/diffusion bonding is disclosed in U.S. Pat. No. 3,927,817 entitled "Method for Making Metallic Sandwich Structures" issued to Howard Hamilton.

The basic superplastic forming process and the several variants of the basic process all require precise control of the gas pressure used to apply forming of pressure to strain the superplastic material in the right direction.

Although superplastic forming has proven to be a valuable and successful manufacturing process, it has not met the original expectations that existed for it when the process was first being explored. One of the primary reasons for the problems that have been experienced in the use of superplastic forming is in the nature of the superplastic process itself. Each superplastic material has an ideal temperature and strain rate at which it can be formed. Deviations from these ideal conditions produce less than optimum results, and sometimes unsatisfactory results altogether. One of the primary reasons for the unsatisfactory results is inability to strain the material at the optimum strain rate. The total elongation, hence the depth of draw of the material, is very much dependent on the strain rate at which the material is formed. If the material is formed too quickly (at to great a strain rate) it may rupture or tear before the forming is finished. It may also undergo work hardening and lose its plasticity. A slow strain rate lengthens the forming cycle and decreases the throughput through the machine. It can also result in grain growth resulting in a decrease of the total possible elongation that can be achieved with that material. A relationship has been devised to quantify this phenomenon and is typically termed "strain rate sensitivity" or "M value" for a particular material. The strain rate at which the material is strained is almost entirely a function of the forming gas pressure and therefore the control over that gas pressure is critical to the optimal utilization of the SPF process.

Since the strain rate at which the material is formed is such a critical parameter to optimum use of the SPF process, it would be desirable to provide a technique for measuring what the actual strain rate is at any particular moment during the forming process. In the past, the strain rate has been calculated from the known M value of the material and the pressure of the forming gas and the configuration of the part. However, the strain rate is not a well enough understood function of the numerous complex factors that influence the strain rate, and so the calculated strain rate is only an approximation of the strain rate actually achieved in practice. It would be of great value to those working in the field to have a process for accurately measuring what the actual strain rate is at any given moment to enable them to precisely tailor the pressure cycle of the forming gas used to form the part in the press.

For superplastic forming back pressure and superplastic forming/diffusion bonding, the forming gas pressure is likewise critical to the process. The pressure on the side of the sheet away from which it is forming must always be at a higher pressure than the side of the sheet toward which it is forming, and the differential pressure must be carefully controlled so that the forming rate is at the optimum forming rate. This requires that the pressure on one side of the sheet be known and that the differential pressure likewise be known so that the back pressure and the forming pressure can both be controlled accurately to produce the optimum results.

SUMMARY OF THE INVENTION

Accordingly, it is an object of this invention to provide a process and apparatus for controlling the forming pressure in an SPF forming apparatus to a far greater degree than was possible with prior art systems.

Another object of the invention is to provide a method and apparatus for sensing the strain rate of the metal blank in an SPF forming apparatus to enable the forming gas pressure to be adjusted in a pressure cycle that closely approximates the optimum forming gas pressure cycle.

These and other objects of this invention are contained in a gas pressure control system having three separate closed loop control loops. A first or main loop is a closed loop feedback system that is controlled by a computer controller and in turn controls a plurality of sub loops, which are all of a closed loop structure. As a superplastic metal blank is being formed, each of the control loops continuously receive pressure information from transducers located within the system. The pressure information is processed by each loop to determine when gas is to be admitted or released through solenoid control valves to increase or decrease the system pressure according to the desired set pressure called for in the predetermined gas pressure cycle.

DESCRIPTION OF THE DRAWINGS

The invention and its many attendant objects and advantages will become more apparent upon reading the following detailed description of the preferred embodiment in conjunction with the following drawings, wherein.

DESCRIPTION OF THE PREFERRED EMBODIMENTS

Figure 1A:
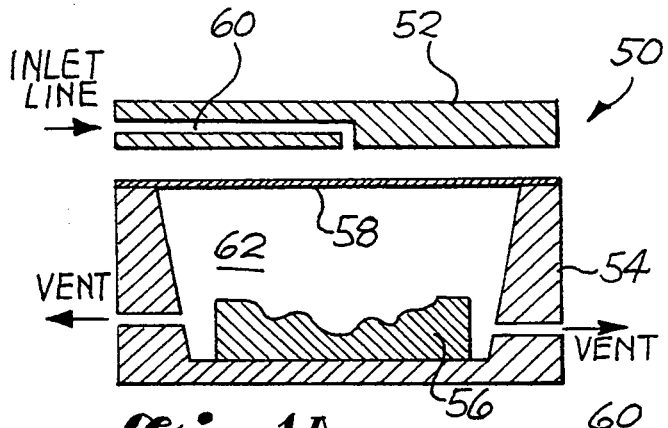
FIGS. 1A–1D are a schematic representation of a superplastic forming cycle using gas pressure to form a superplastic metal blank.

Referring now to the drawings wherein like reference characters designate identical or corresponding parts, and more particularly to FIG. 1 thereof, a superplastic forming cycle is illustrated in a superplastic forming apparatus 50 having a lid 52 and a forming chamber 54 containing a die 56. A piece of sheet metal 58 exhibiting superplastic forming characteristics referred to the art as "strain rate sensitivity" is placed on the top of the forming chamber 54. The piece of sheet metal 58 is normally referred to as the "blank" and will be so referred to herein.

Figure 1B:
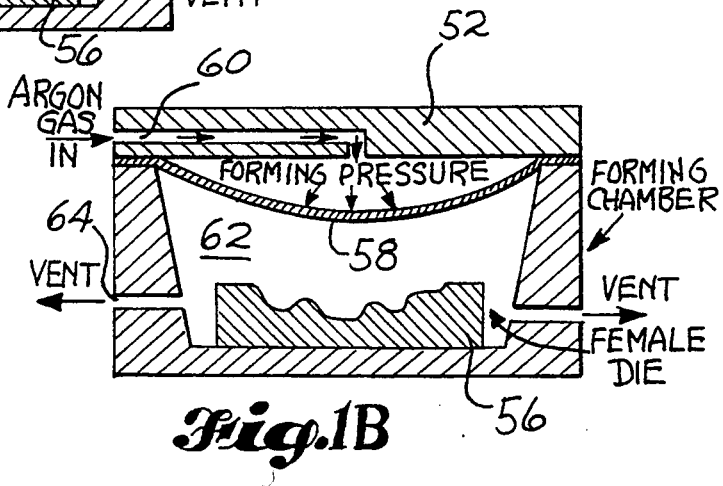

As shown in FIG. 1B, the lid 52 is lowered onto the top of the forming chamber 54 to clamp the blank 58 between the lid 52 and the top of the forming chamber 54. The blank 58 is heated to superplastic temperature, usually by preheating the forming chamber and the lid, and when the blank 58 has reached superplastic temperatures, a forming gas, preferably dried argon, is injected under pressure through an inlet line 60 to pressurize the space between the underside of the lid 52 and the top surface of the blank 58. The pressure of the forming gas acting against the top surface of the blank 58 deforms the blank in a bulge illustrated in FIG. 1B into the cavity 62 of the die 56. As gas is displaced from the cavity 62 of the forming chamber 54 by the descending blank 58, the displaced gas is vented to atmosphere through vents 64.

Figure 1C:
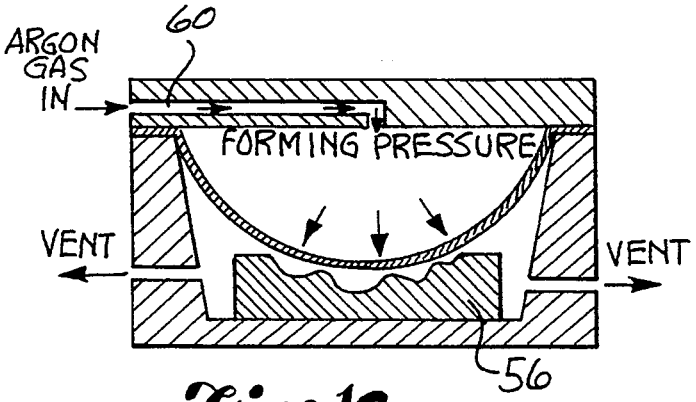
Figure 1D:
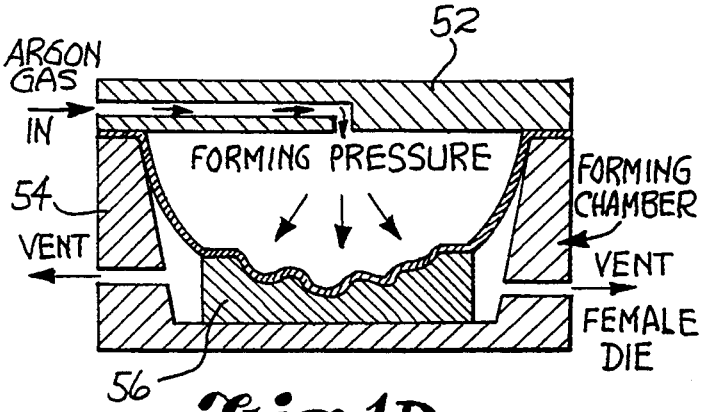

The blank 58 continues to strain under the influence of the forming pressure exerted by the argon gas injected through the inlet line 60 as shown in FIG. 1C until it reaches the upper surface of the die 56 as shown in FIG. 1D. When it reaches the die, the blank conforms to the external configuration of the die 56 to produce a part of the desired configuration. When the blank is fully formed against all the surfaces of the die 56 as shown in FIG. 1 D, the forming pressure is relieved and the lid 52 is released and removed from the forming chamber 54. The formed blank 58 is cooled below superplastic temperature and is removed from the die 56 and the forming chamber 54 and is trimmed to make the part of the desired configuration.

Back pressure superplastic forming, illustrated in FIGS. 2A through 2D, is a process for exerting gas pressure on both sides of the metal blank to prevent or minimize the formation of cavitation in the metal.

Figure 2A:
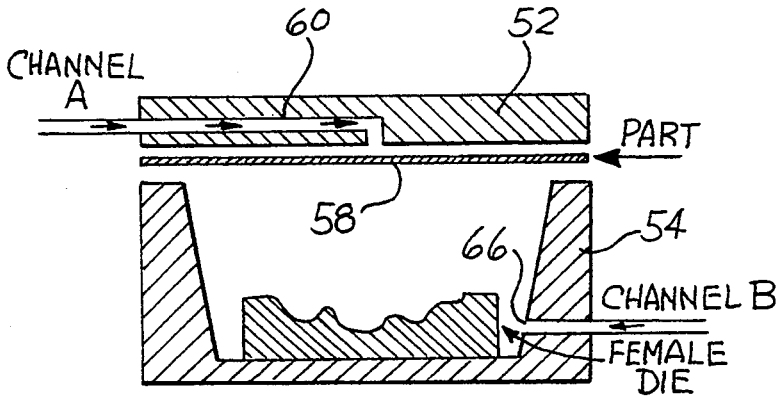
FIGS. 2A–2D are a schematic representation of a superplastic/back pressure forming cycle using gas pressure to form a metal blank and prevent cavitation of the metal blank during forming.
Figure 2B:
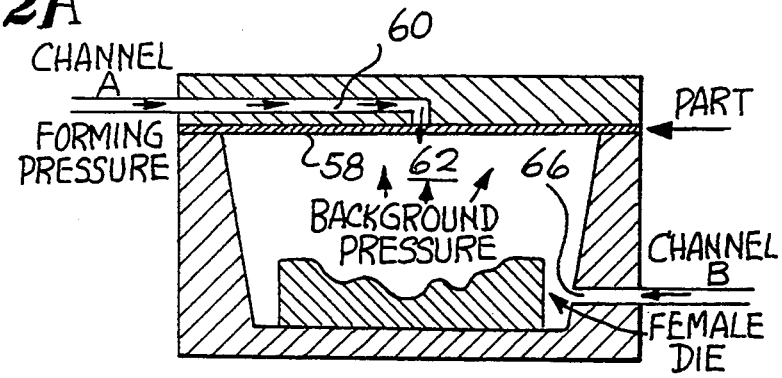
Figure 2C:
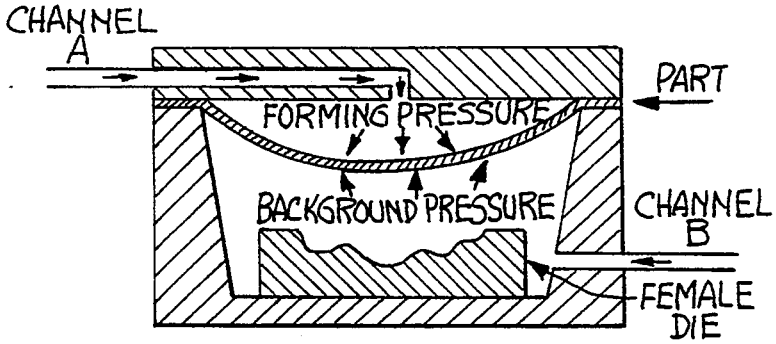
Figure 4:
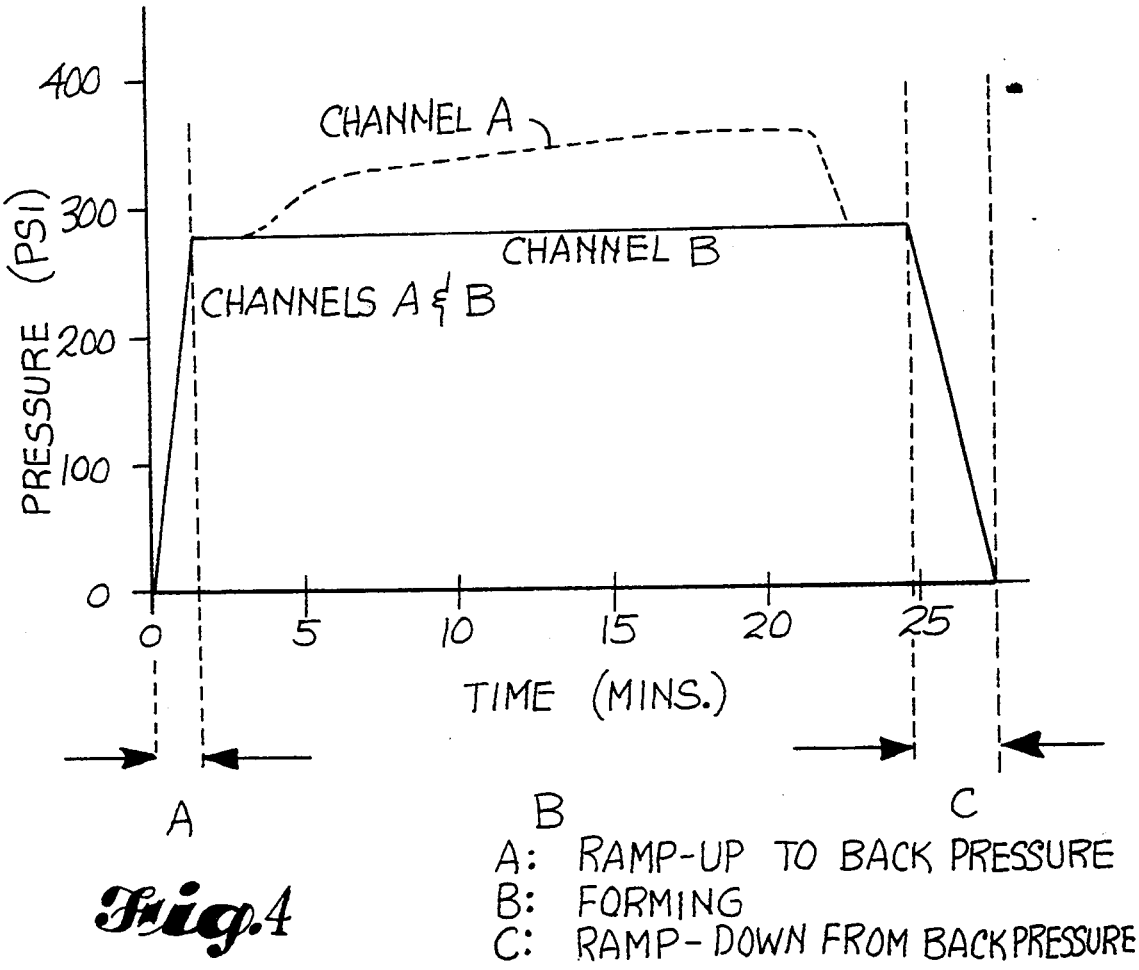
FIG. 4 is a diagram of a representative pressure schedule showing the pressure in the two channels of the apparatus shown in FIG. 3 for the three phases of the forming cycle.
Figure 3:
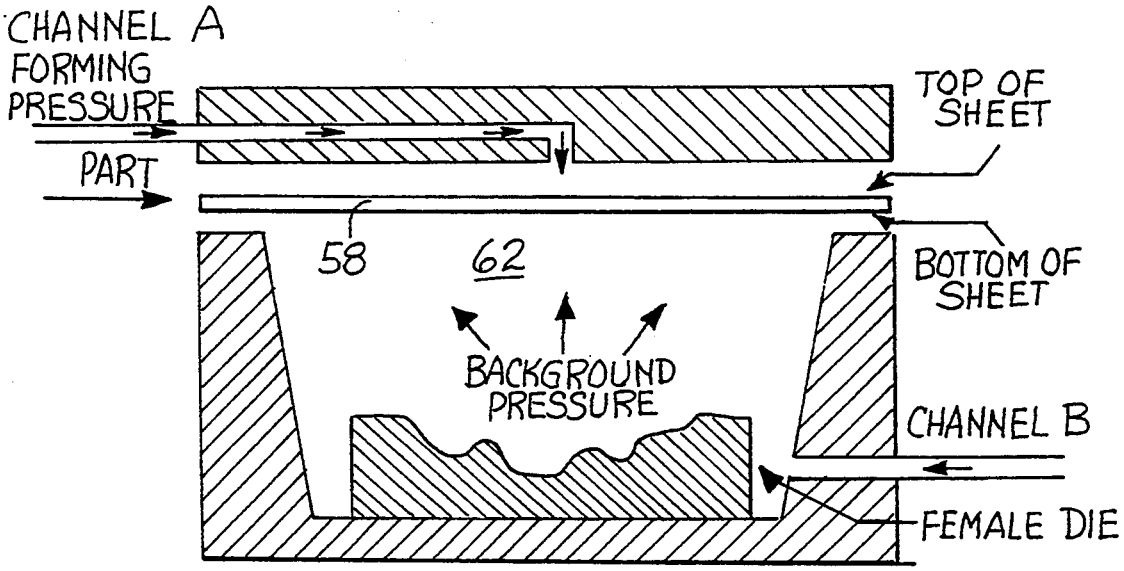
FIG. 3 is a schematic cross section of superplastic/-back pressure forming apparatus illustrating the two channels of forming pressure in the die lid and the pressure chamber.

As shown in FIG. 2a, the metal blank 58 is placed on top of the forming chamber 54 and the lid 52 is placed over the metal blank and clamped in place by a press or the like, in the same manner as FIG. 1A. Heat is applied to raise the temperature of the metal blank 58 to the superplastic forming temperature, whereupon gas is injected through the inlet line 60 and also through an inlet line 66 in the forming chamber 54 as shown in FIG. 2B. The pressure of the forming gas injected through the inlet lines 60 and 66 is illustrated in FIG. 4, as having two pressure channels and a pressure schedule over a three zone forming cycle. The Zone A, illustrated in FIG. 4, is a ramp-up phase during which the pressure on both sides of the blank shown in FIG. 2B is equal. During this phase, the pressure is raised to the suitable pressure between 200 and 300 psi equally on both sides of the blank 58 to exert a squeezing force on the blank 58. Once the squeezing gas pressure of the desired magnitude has been reached, the forming phase begins as illustrated in the Zone B in FIG. 4 and in FIGS. 2C and 2D. In this phase, the pressure in channel A is gradually increased so that the gas pressure on the surface between the lid 52 and the adjacent surface of the blank 58 increases gradually as illustrated in the dotted line representing the pressure in channel A in FIG. 4. The back pressure in the forming chamber 62 is maintained at the same level throughout the forming, as represented by Zone B in FIG. 4, so that a high pressure squeezing force is maintained on the blank 58 while it is forming. This squeezing pressure reduces the formation of cavitation in the blank and maintains the strength properties of materials that otherwise would be prone to cavitation in superplastic forming processes.

Figure 2D:
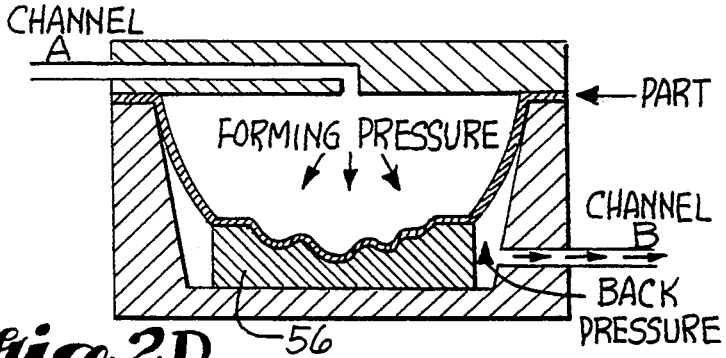

After the metal blank 58 is fully formed against the facing surface of the die 56 as shown in FIG. 2D, the pressure in channel A is reduced back to the magnitude of the pressure in channel B and then the pressure in both channels A and B is reduced in a ramp-down schedule illustrated in Zone C of FIG. 4.

Figure 6:
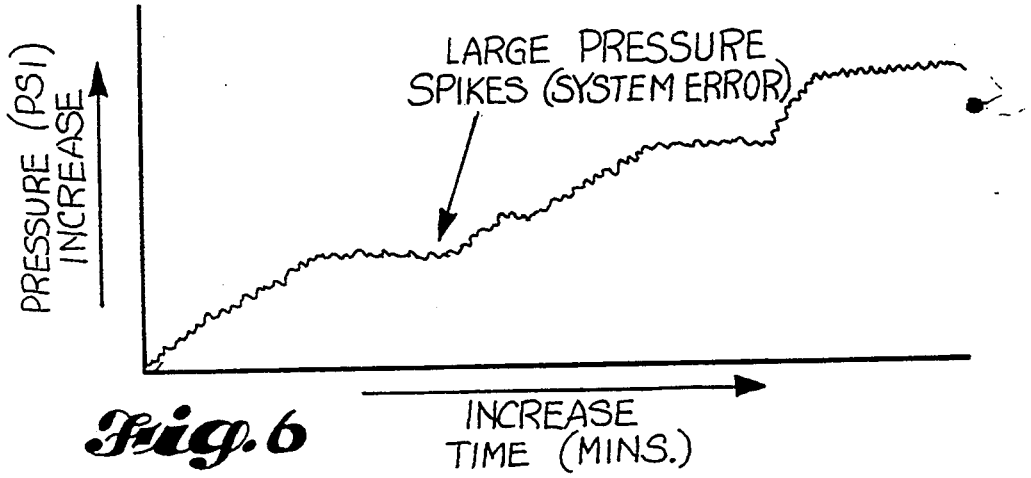
FIG. 6 is portion of a graph of a typical gas pressure cycle as actually experienced on a conventional superplastic forming apparatus.
Figure 5:
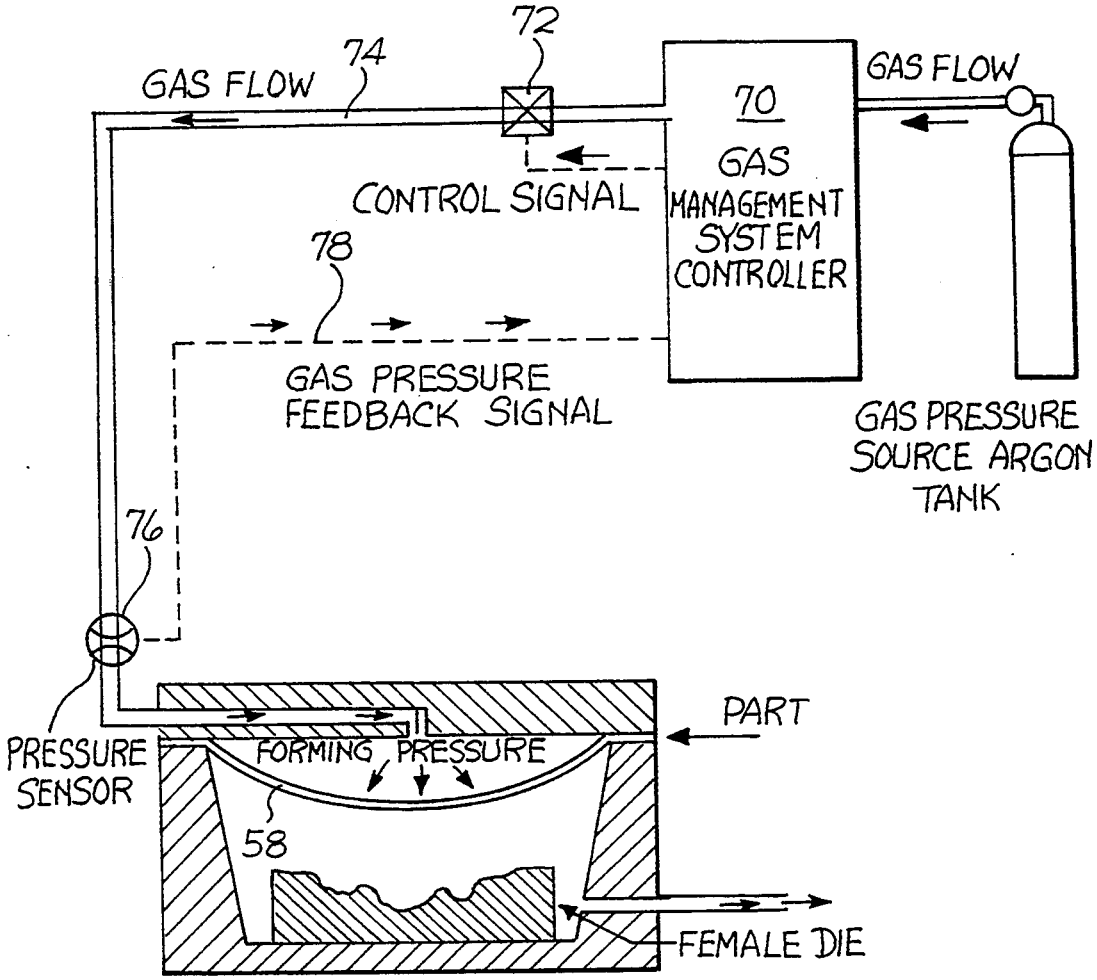
FIG. 5 is a cross-sectional elevation of a superplastic forming apparatus and a schematic of a conventional gas pressure control system.

The conventional apparatus for controlling the gas pressure cycle for the gas used to form superplastic parts in a superplastic forming apparatus is shown in FIG. 5. It includes a gas management system 70 which controls a valve 72 to allow gas to flow through a line 74 at a pressure predetermined by the desired pressure schedule such as that illustrated in channel A of FIG. 4. A pressure sensor 76 senses the pressure in the line 74 and conveys a signal over a conductor 78 to the gas management system controller 70 to adjust the regulator 72 if there is a deviation from the desired pressure as sensed by the pressure sensor 76. A pressure control system as shown in FIG. 5 produces a pressure profile at the tool illustrated in FIG. 6. Each time the valve opens to admit gas to increase the pressure in the tool, the full pressure of the gas in the source is applied to deliver a pulse of gas into the gas line 74, producing a large pressure spike 6. The pressure profile produced by the system of FIG. 5 thus resembles a jagged line as shown in FIG. 6 which is substantial deviation from the desired smooth pressure profile. Since the strain rate of metal blank 58 is a sensitive function of gas pressure, the actual strain rate that the metal blank experiences in the apparatus shown in FIG. 5 will be a reflection of the jagged line shown in FIG. 6, instead of a smooth, straight line representing the desired uniform strain rate.

Figure 8:
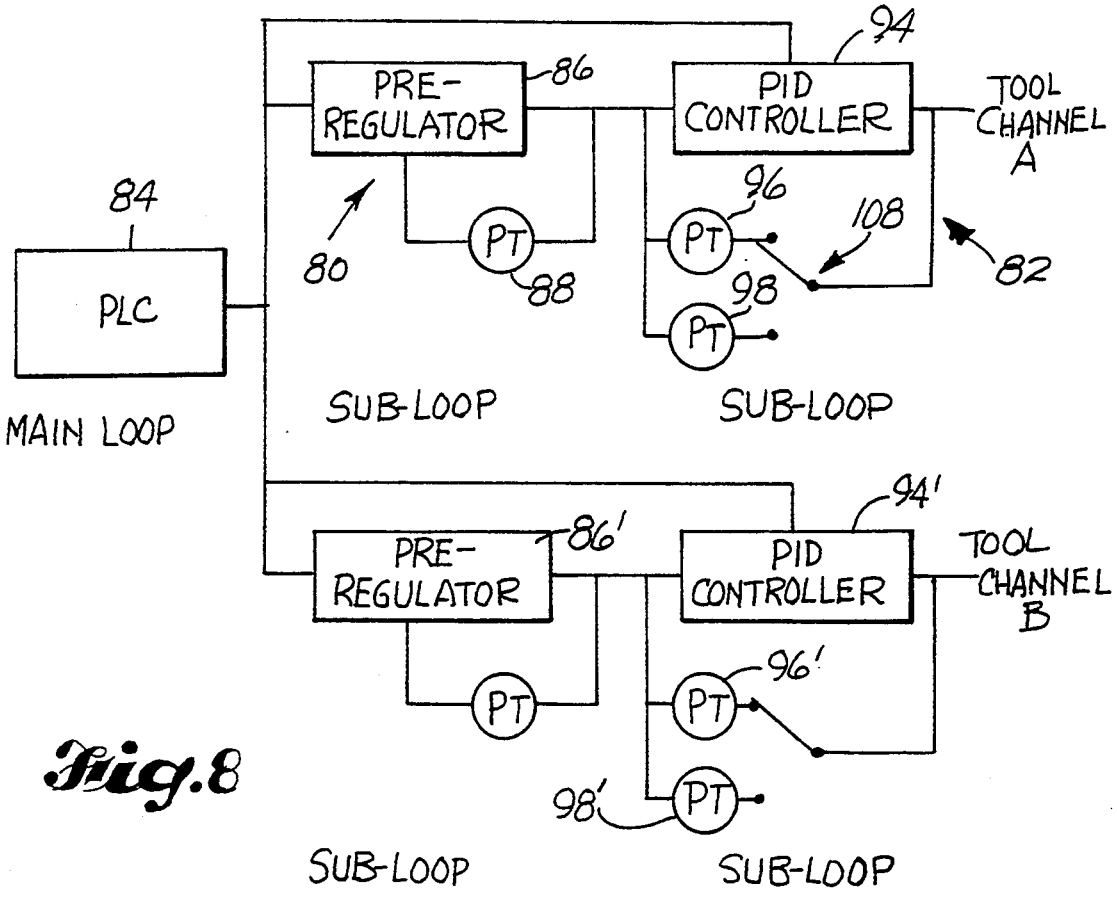
FIG. 8 is functional control diagram of the control elements of the gas control system illustrated in FIG. 7.
Figure 7:
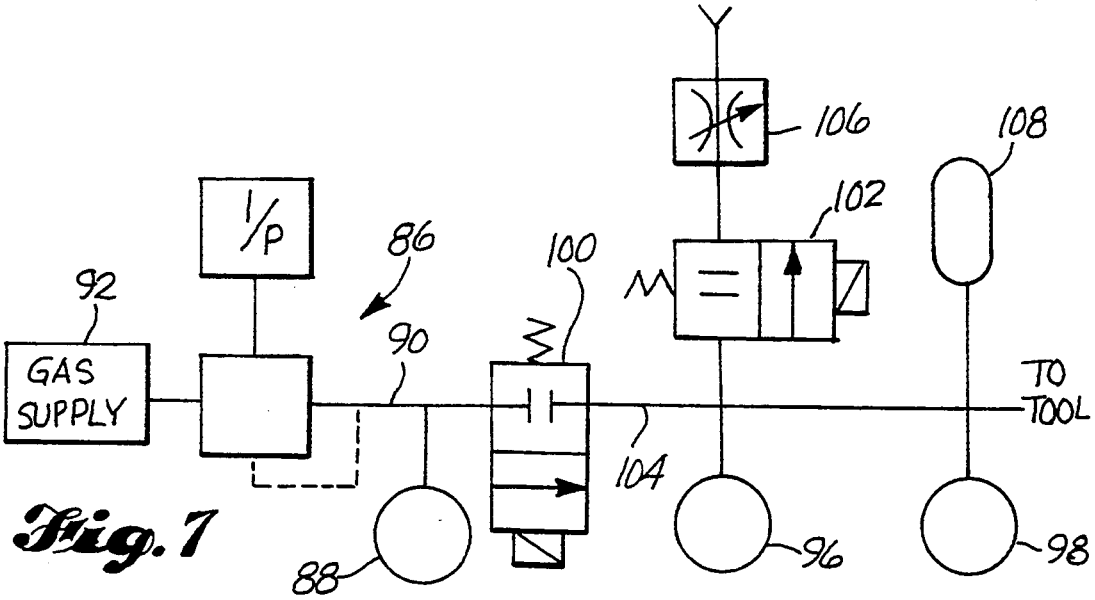
FIG. 7 is a schematic diagram of one channel of a two-channel gas pressure control system according to this invention.

A gas control methodology according to this invention is illustrated in FIG. 7, and a representative control system using this methodology is illustrated in FIG. 8. As illustrated, two control sub loops 80 and 82 are in turn controlled by a master controller such as PLC 84 which is part of a gas management system controller 85. The controller 85 (illustrated in FIG. 11) includes a personal computer (not shown) on which pressure schedules are written and then downloaded to the PLC 84, and provides for various modes of operation, including simple one sheet superplastic forming, backpressure superplastic forming, and diffusion bonding/superplastic forming.

In sub loop 80, a pre-regulator 86 and a pressure transducer 88 are connected to the PLC 84 to reduce the gas pressure in a gas line 90 in a piping network between a gas supply 92 and the forming chamber in the superplastic forming apparatus 50. A pre-regulator 86 reduces the gas pressure in the gas line 90 to a desired value which is communicated to the pre-regulator 86 from the PLC 84. The pressure transducer 88 senses the pressure in the line 90 and communicates that information back to the PLC which makes necessary adjustments in the pre-regulator if the pressure deviates from the instantaneous set pressure desired for line 90 in the pressure cycle which has been programmed into the PLC.

A second sub loop 82 shown in FIG. 8, also in channel A, includes a PID controller 94 and a pair of pressure transducers 96 and 98. The PID controller is updated from the PLC to control a pair of solenoid valves 100 and 102, shown in FIG. 7, which allow pressure from the line 90 to flow into the gas line 104 or out of the gas line 104 through an adjustable needle valve 106, respectively. The pressure transducer 96 is a high range pressure transducer operable over the full pressure range in which the system is designed to operate. The pressure transducer 98 is a low range pressure transducer having a higher degree of accuracy at the low pressure range at which extreme accuracy is desired for precise process control during critical periods of operation, typically on the order of 0–20 psi. An accuracy in this range on the order of plus or minus 0.15% of the pressure reading gives a higher degree of accuracy than the high range pressure transducer 98.

A switch 108 connects one or the other of the pressure transducers 96 or 98 into the control loop 82 to provide pressure feedback to the PID controller 94. At the high range of pressure, the switch 108 is in the position shown in FIG. 8 to couple the high range pressure transducer 96 into the control loop 92. At the low range of pressure, the switch 108 is operated to the other switch position to connect the low range pressure transducer 98 into the control loop 92.

To prevent instability when the system is operating in the region of pressure between the low range and the high range pressure transducer 96 and 98, that is, between 10 and 20 psi, a hysteresis loop is built into the latter logic of the PLC 94. The hysteresis loop sets the cross over point, the point at which the controller uses transducer feedback from one transducer and not the other transducer, during a pressure ramp up at one pressure, for example, 16 psi, and sets the cross over point at a lower pressure for example 13 psi during a pressure ramp down. The hysteresis concept prevents an instability of the control system should the system pressure be commanded to hold at the cross over pressure.

The needle valve 106 has a vernier scale which allows it to be manually adjusted precisely to a desired cross sectional orifice area so that, when gas is released through the solenoid operated valve 102 during reduction in pressure in the line 104, the pressure decreases at a controlled rate and does not result in disruptive pressure spikes which otherwise could result if the orifice at the exit orifice of the solenoid operated valve 102 were merely an unrestricted opening to atmosphere. The needle control valve 106 in the preferred embodiment is a manually adjusted valve with a visible scale which enables an operator to adjust the valve while looking at the scale to obtain the desired cross-sectional orifice area. This is a satisfactory arrangement because the needle valve does not need frequent adjustment. However, if frequent adjustment of the needle valve 106 were necessary, a remotely operable needle valve controlled from the PLC 94 could be substituted in its place.

An accumulator bottle 109, shown in FIG. 7, is connected into the line 104 for each tool channel A and B to reduce the amplitude of any spikes caused by pulses of pressure introduced through the solenoid valve 100 or pulses of pressure released by the solenoid valve 102 through the needle valve 106. This accumulator bottle 109 smoothes out the pressure curve to dampen any pressure spikes that could occur by use of these quick acting solenoid valves 100 and 102 so that the pressure ramp seen by the metal blank in the superplastic forming apparatus 50 closely approximates the desired smooth curve illustrated in FIG. 4.

Figure 9:
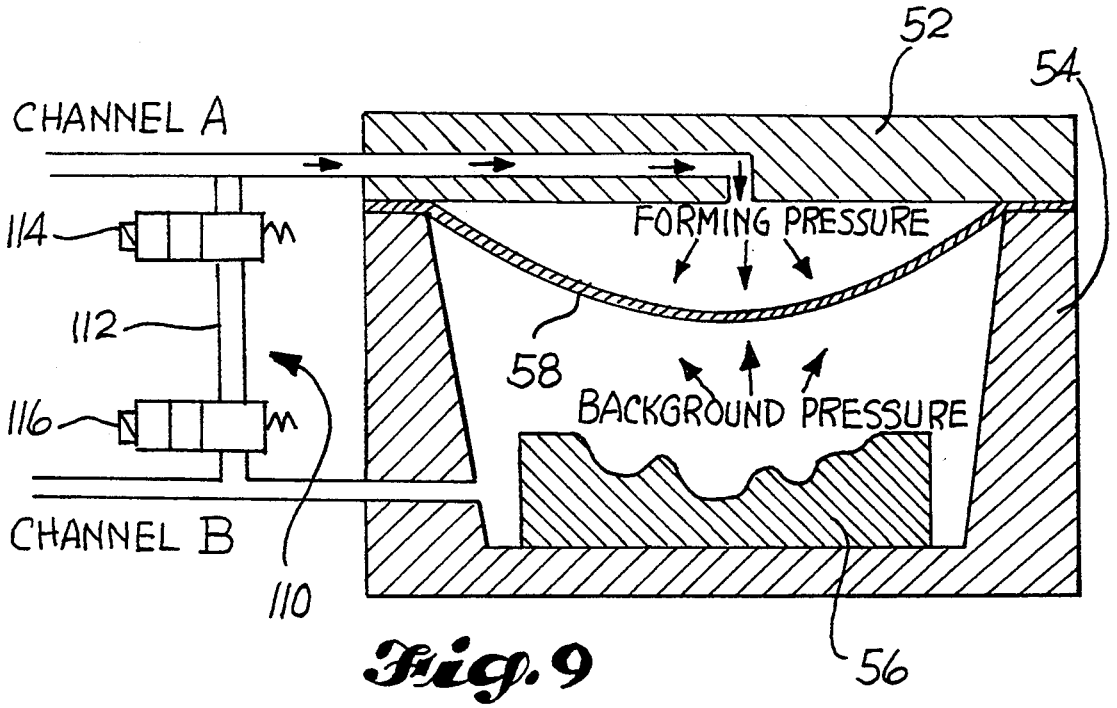
FIG. 9 is a crossectional elevation of a superplastic forming apparatus and a schematic of a cross-channel connecting line and valves for selectively equalizing the pressure on both sides of the blank in accordance with this invention.

Turning now to FIG. 9, a cross channel connecting valve 110 is shown connected in a cross channel line 112. The cross channel connecting valve 110 is for the purpose of insuring that the pressure on both sides of the metal blank 58 are at equal pressure during ramp-up of the pressure for back pressure forming as shown in FIG. 2B and the pressure schedule shown in FIG. 4. Likewise, during the ramp-down phase, Zone C in FIG. 4, it is necessary that the pressure on both sides of the blank, as illustrated in FIG. 2D, be equal to prevent differential pressure from pealing the blank 58 off of the die 56. During periods of differential pressure, as in Zone B of FIG. 4, the valve 110 is closed and the differential pressure is controlled by a differential pressure controller illustrated in FIG. 10 and discussed below. The line 112 for the cross channel connecting valve 110 is connected in the piping network between the pressure source for the forming gas and the pressure chamber to equalize the pressure on both sides of the blank 58, as shown in FIG. 11, as well as for other functions to be described below.

As illustrated in FIG. 9 the cross channel connecting valve 110 is actually a pair of solenoid operated valves 114 and 116 arranged in opposition, but this is merely a practical solution to the fact that the particular valves used in this system, in the closed position, tend to leak in the direction opposite to which they are normally exposed to pressure, so two valves are used to prevent leaks in either direction. The two valves 114 and 116 can be replaced with a single valve that does not leak in either direction when it is closed.

Figure 10:
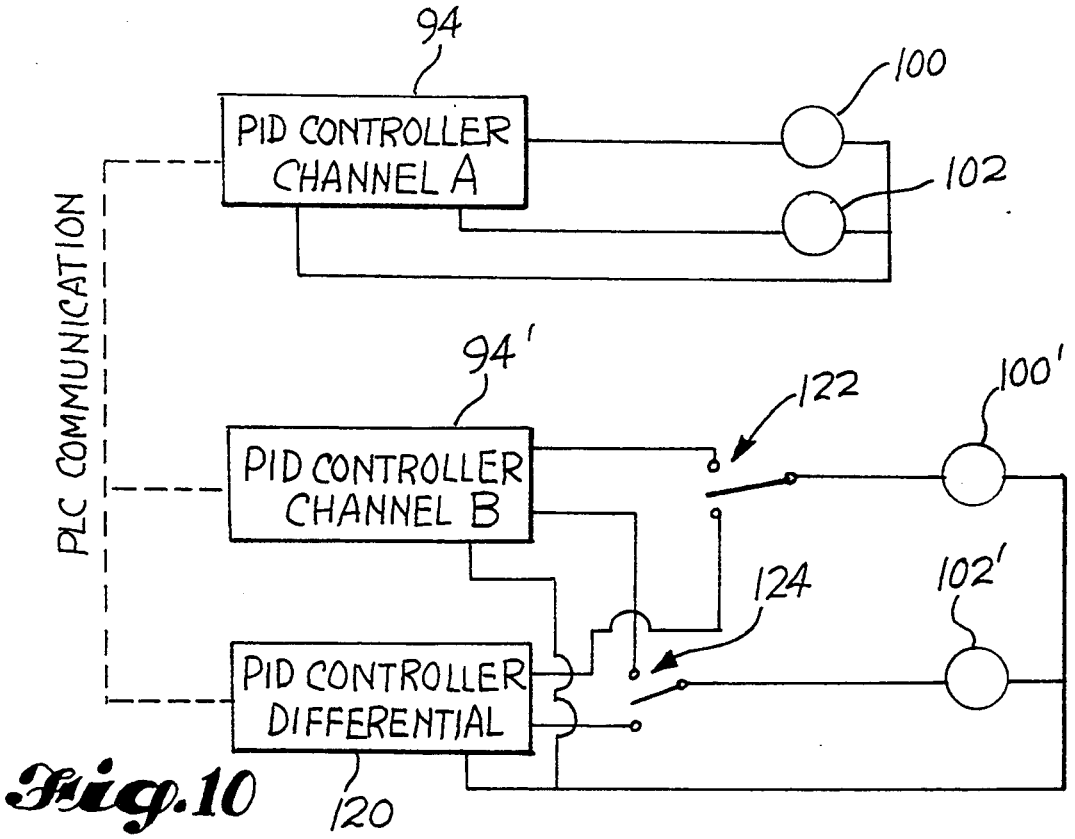
FIG. 10 is a functional diagram of the control elements of the gas control system for controlling the differential pressure across the blank in the apparatus of FIG. 9.
Figure 11:
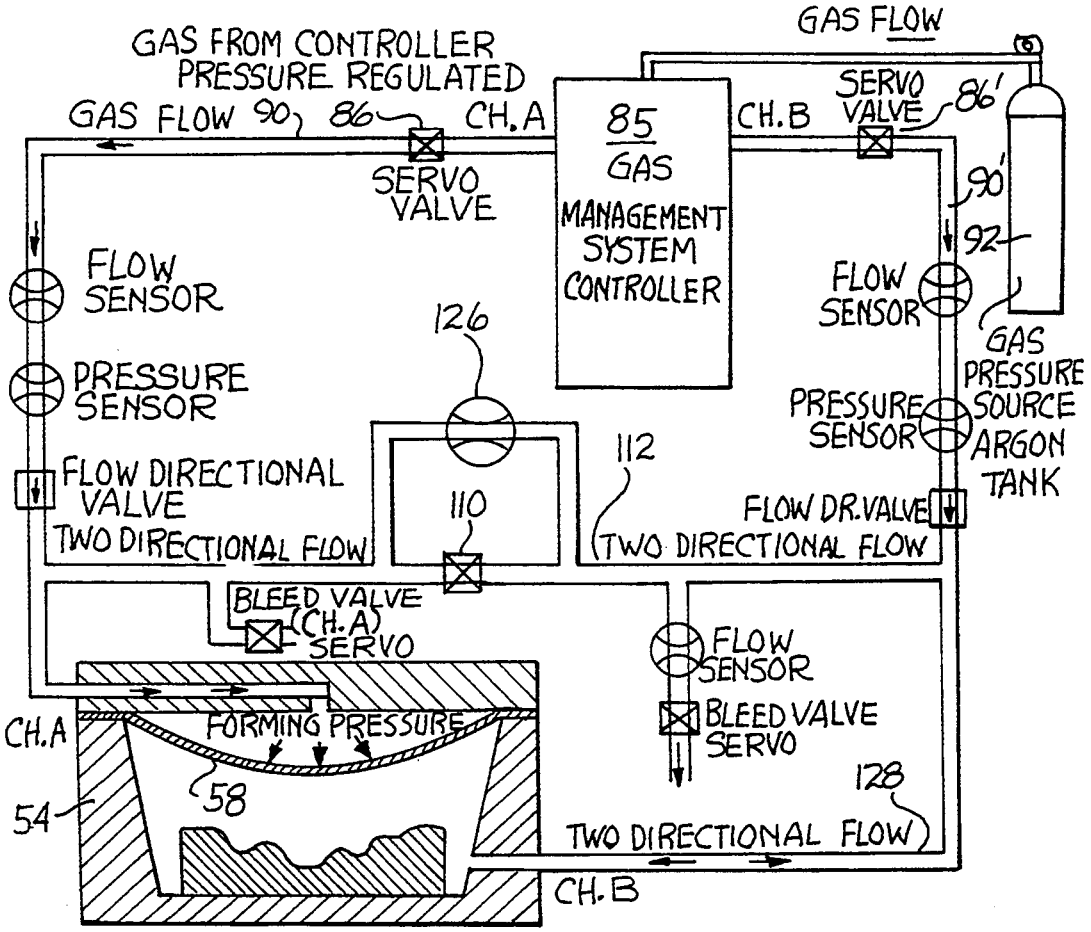
FIG. 11 is a schematic diagram of a gas control system used to measure and control the strain rate of the blank in the superplastic forming apparatus illustrated.

A PID controller 120 is provided, as shown in FIG. 10, for controlling the differential pressure between channels A and B. During back pressure superplastic forming as illustrated in FIGS. 2A through 2D and FIGS. 3 and 4, the PID controller 94' for channel B is disabled by selective operation of a pair of switches 122 and 124 connected between the PID controllers 94' and 120, and the pressure increase solenoid 100 and the pressure decrease solenoid 102. As shown in FIG. 11, a pair of differential transducers 126 (shown in FIG. 11 as combined in a single symbol 126) are connected to the PID differential pressure controller 120. Similar in function to the transducers in each channel A and B illustrated in FIG. 8, the differential transducers use a low end differential pressure transducer and a high end differential pressure transducer, illustrated as a single symbol 126, but operating in the same manner as the paired pressure transducers 96 and 98.

The low end differential pressure transducer of the pair 126 is used for controlling differential pressures between zero and plus and minus 45 psi. The low end differential pressure transducer of the pair 126 has a pressure tolerance of plus or minus 0.05 psi to produce very accurate readings at low differential pressures. The high end differential pressure transducer of the pair 126 is used for controlling differential pressures between 45 psi and 200 psi. This transducer has a pressure tolerance of plus and minus 0.2 psi and is used to control the process only at differential pressures exceeding 45 psi.

To prevent control instability at the cross over point between the two transducers 126, a hysteresis loop is built into the logic of the PLC 84 to set the cross over point at 45 psi during a pressure ramp-up, and set the cross over point at 42 psi during the pressure ramp-down, for the same purpose as mentioned previously for the pressure transducers 96 and 98.

Turning again to FIG. 11, a gas mass flow feedback system is illustrated for measuring the mass flow of gas out of the pressure chamber 54, thereby providing an accurate indication of the strain rate of the blank 58 independently of gas pressure inside the pressure chamber, which we have discovered does not directly correlate to the actual forming rate that is occurring in the chamber 54. Accurate knowledge of the flow rate of the blank 58 can significantly reduce the time required to produce parts and increase the quality of the pads in terms of reduced thinning of materials and fewer part failures due to tearing.

Figure 13A:
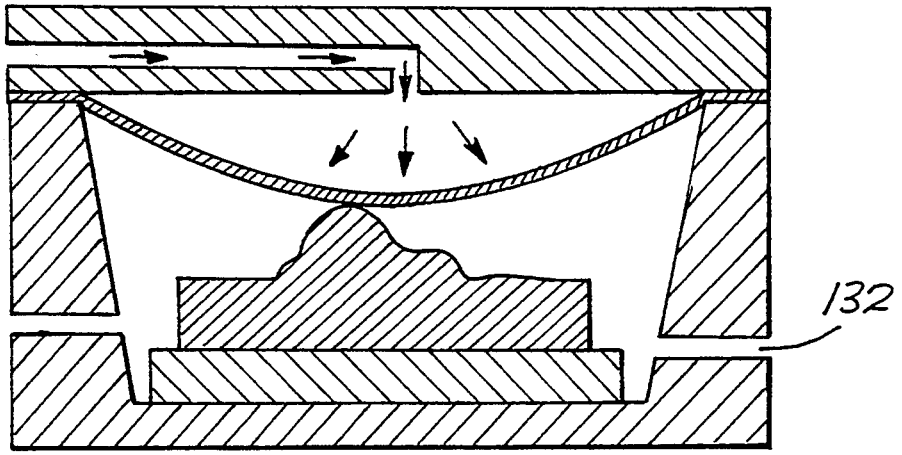
FIGS. 13 A and 13 B are schematic illustrations showing the effect of the blank contacting the die on the gas outflow from the pressure chamber.
Figure 13B:
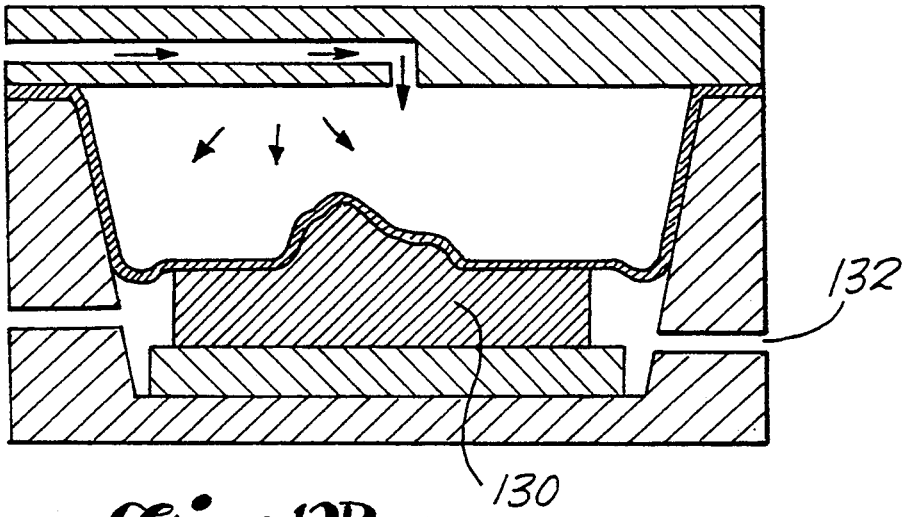

Referring to FIGS. 13A and 13B, a typical SPF process using a male die 130 is illustrated during the middle and latter forming stages of the process. In the earlier stages of the forming process, a large surface area of material was streached and forced down into the pressure chamber 54. When the material of the blank 58 reaches the die 130 and contacts the die, it sticks to the die and, where it is stuck on the die, it no longer streaches. All remaining streaching is then done by portions of the blank 58 that are not stuck to the die 130, and the remaining surface area that is available to streach and deform down into the pressure chamber 54 becomes less and less as more of the die 130 is contacted by the material of the blank 58.

As noted previously, the displacement of the blank 58 into the pressure chamber 54 displaces gas in the chamber, out through the opening 132 to channel B. As the material of the blank drapes onto the die 130, there is a reduced degree of stretching on the material, and an exact reduction in the quantity of gas that is displaced through the opening 132. Thus, a direct relationship exists between the rate of stretching of the blank material and the mass flow rate of gas out through the opening 132 during the majority of the cycle.

Some materials have been shown to have a variable optimum strain rate. For these materials, the direct measurement of strain rate is particularly beneficial because it enables the actual instantaneous strain rate to be ascertained so that the desired variable rate can be very closely replicated by the gas control system.

Figure 14:
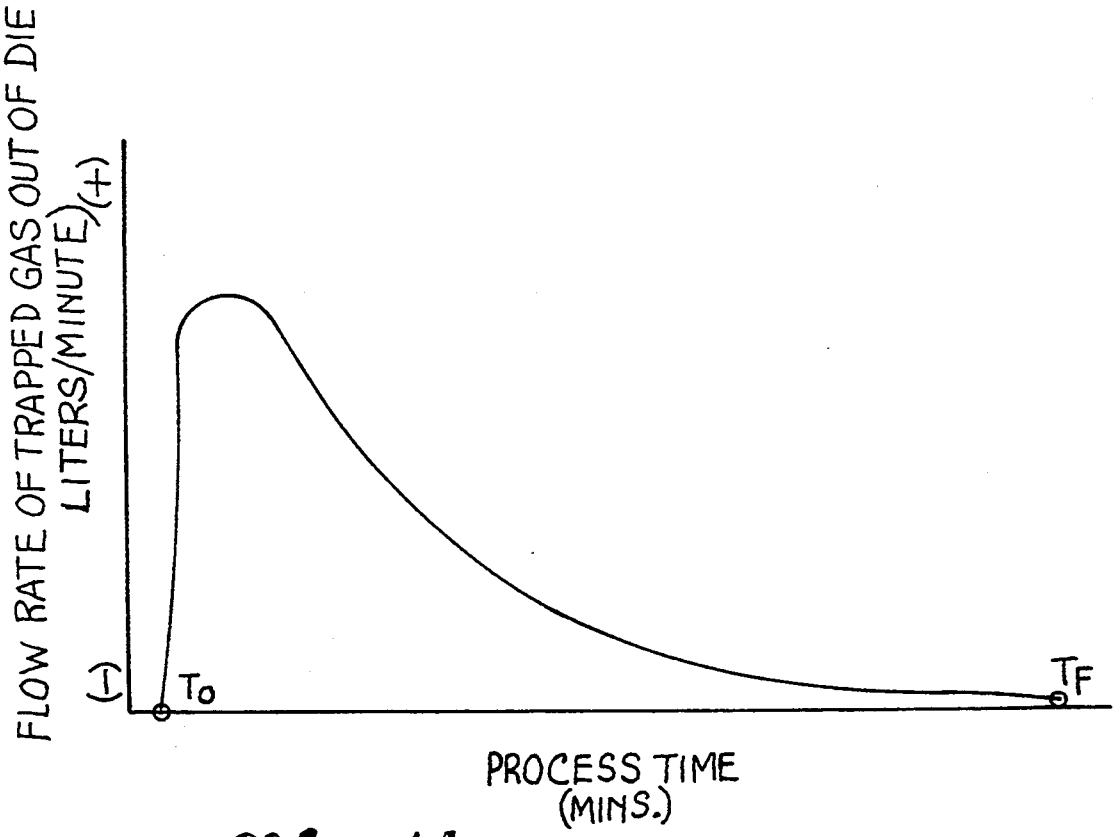
FIG. 14 is a graph showing the change in gas outflow from the pressure chamber as the cycle progresses and the blank contacts the die.

A truly optimum forming cycle must account for the reduction of gas flow rate out of the pressure chamber 54 as the blank material sticks progressively to the die 130. The gas flow rate will decrease because a lower percentage of the blank is displacing gas from the chamber 54, but the localized strain rate of the blank material may still remain at the optimum magnitude. The system therefor changes the relationship between mass flow rate of gas displaced out of the pressure chamber and strain rate of the blank by reducing the desired mass flow rate from the opening 132. Accordingly, when an pressure schedule for a superplastic part is being developed, the desired mass flow rate to be maintained out of the pressure chamber will resemble the graph in FIG. 14 to account for the phenomenon of reduced displacement of gas from the pressure chamber by reason of increasing contact of the blank material on the die.

Figure 12:
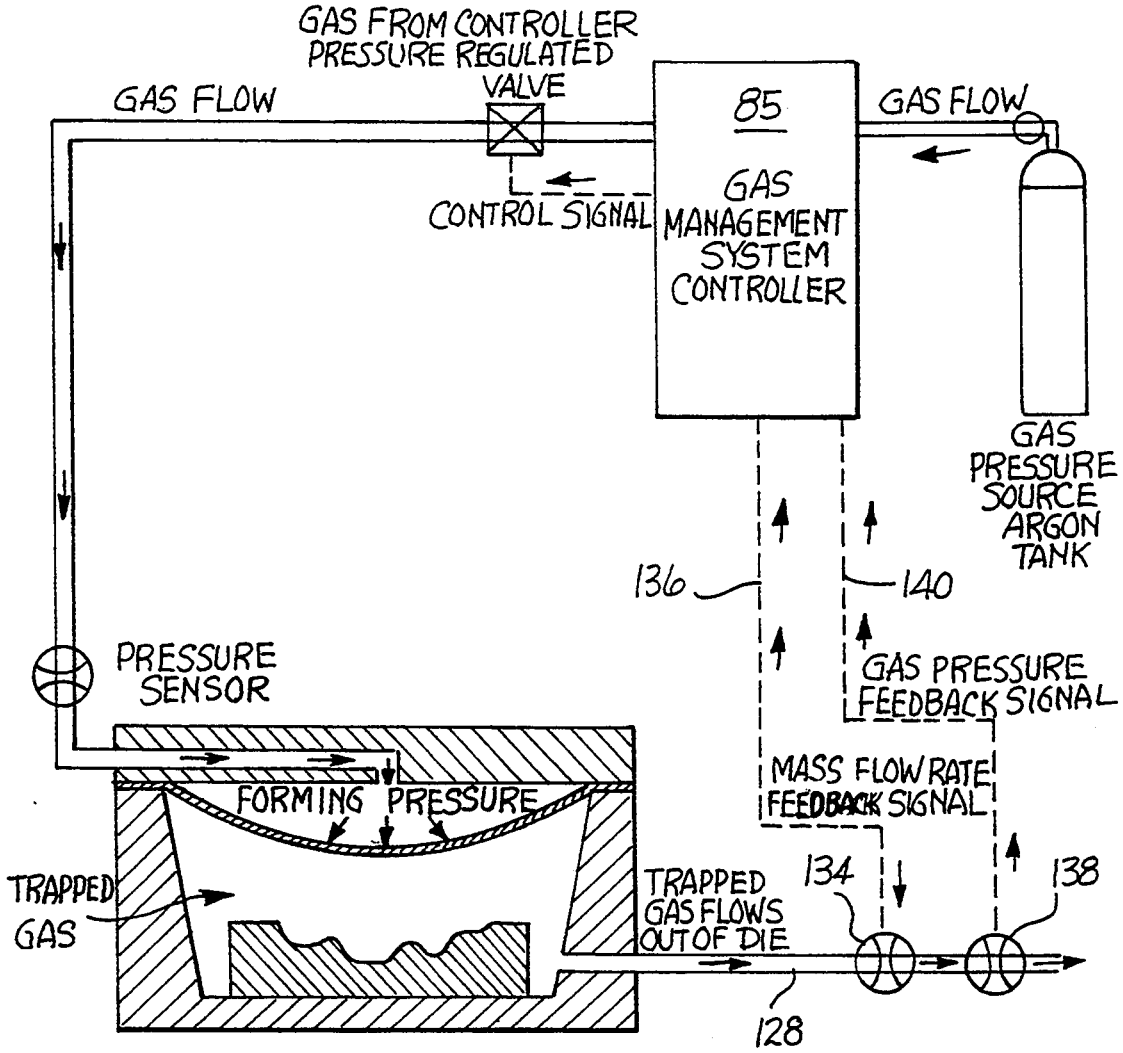
FIG. 12 is a schematic diagram of the strain rate measurement and control system shown in FIG. 11.

The basic design theory of the mass flow rate system for measuring the strain rate of the superplastic blank material is illustrated in FIG. 12. A gas mass flow rate sensor 134 is placed in the gas line 128 connected to channel B, and a conductor is connected between the mass flow rate sensor 134 and the PLC 84 in the gas management system controller 85. A pressure transducer 138 is positioned in the line 128 downstream of the mass flow rate sensor 134 in the direction of outflow of gas from the pressure chamber and produces an electrical indicative of the gas pressure. That signal is conducted by way of a conductor 140 the the PLC 84. The PLC follows a predetermined flow rate schedule, such as that shown in FIG. 14, to update the PID controllers 94 and 94', and the preregulators 86 and 86' to produce a pressure in the inlet line 60 that will produce a mass flow rate of gas through the sensor 134 to match the preestablished schedule preprogramed into the PLC 84, for example, the schedule shown in FIG. 14. The use of the pressure transducers and the pressure control loops discussed previously in connection with FIG. 8 are not eliminated by the reliance on the gas mass outflow rate measurement, the several measurement are collected and compared to ensure that an abberant condition has not occured that would result in a ruined part. For example, if the maximum forming pressure anticipated in the process is reached before the alloted ramping and holding time for the particular step in the cycle has been completed, the pressure will be held at the maximum for that step instead of being increased to attain the scheduled gas mass outflow rate (unless the mass flow rate decreases below the programmed rate ), which allows for some margin of error in flow programming or some other variability in the numerous parameters that influence the results. Thus, the control of the forming process is still accomplished using pressure regulating valves and feedback from pressure transducers, but the flow rate for a given step is approximately maintained through a given pressure range.

Obviously, numerous modifications and variations of the described preferred embodiments will occur to those skilled in the art in view of this disclosure.

Accordingly, it is expressly to be understood that these modifications and variations, and the equivalents thereof, may be practiced while remaining within the spirit and scope of the invention, as defined in the following claims, wherein we claim:

1. A gas management system for a superplastic forming machine, comprising:

a source coupling for connecting a source of high pressure inert gas to said system, and a die coupling for connecting said system to said die;

an inlet piping network connected between said source coupling and said die coupling;

a pressure control in said inlet piping network for highly accurate control of gas pressure delivered by said inlet piping network to said die coupling;

said pressure control including a first pressure transducer and, operatively coupled thereto, a first pressure regulator for reducing the inert gas pressure in said inlet piping network downstream of said first pressure regulator from a high pressure to a lower pressure only slightly higher than a desired set pressure, and a second pressure transducer and a second pressure regulator for reducing said inert gas pressure downstream of said second pressure transducer from said lower pressure to said set pressure.

2. A gas management system as defined in claim 1, wherein:

said second pressure regulator is remotely controlled from a computer controller, programmed to follow a predetermined ramp schedule.

3. A gas management system as defined in claim 1, wherein:

said second pressure transducer operates only at low pressures and over a smaller pressure range than said first pressure transducer, and is substantially more accurate at said smaller pressure range than said first pressure transducer.

4. A gas management system as defined in claim 2, wherein:

said first pressure transducer reduces said gas pressure from very high pressure, on the order of said source pressure, to about 50 psi above the pressure required by said predetermined ramp schedule.

5. A gas management system as defined in claim 2, further comprising:

a gas mass flow sensor for measuring gas mass flow out of a die base when a blank is strained by said gas pressure into said die base, displacing gas therefrom.

6. A gas management system as defined in claim 5, wherein:

said gas mass flow sensor produces signals for transmission to said computer, and said predetermined ramp schedule is a schedule of mass flow rates through said mass flow sensor.

7. A gas management system for delivering an inert gas under a controlled pressure through a first portion of a piping network to a region of a forming die between a die lid and a blank to be formed in a superplastic forming machine, comprising:

a gas pressure regulator in said piping network;

a first control loop including a first pressure transducer communicating with said piping network downstream of said gas pressure regulator and operatively with said gas pressure regulator;

a second control loop including a pulse controller downstream of said first pressure transducer and a second pressure transducer communicating with said piping network downstream of said pulse controller and operatively with said pulse controller;

said gas pressure regulator being adapted to receive signals from a controller to adjust the pressure at which said gas pressure regulator opens to release gas through said pressure regulator,whereby said system can deliver inert gas to a superplastic forming die at a predetermined pressure on a predetermined schedule to achieve optimum forming speed and quality.

8. A gas management system as defined in claim 7, further comprising:

a third gas pressure transducer in a second portion of said piping network connected to a die base for delivering forming gas to a region of said die base on the side of said blank opposite to the side on which said first portion of said piping network delivers said gas;

a third control loop including a third pressure transducer communicating with said second portion of said piping network downstream of said second gas pressure regulator and operatively with said third gas pressure regulator;

a fourth control loop including a second pulse controller downstream of said second pressure regulator and a forth pressure transducer communicating with said piping network downstream of said second pulse controller and operatively with said second pulse controller;

said second gas pressure regulator being adapted to receive signals from said controller to adjust the pressure at which said second gas pressure transducer opens to release gas through said second gas pressure regulator, whereby said system can deliver inert gas to a base portion of a superplastic forming die at a predetermined pressure on a predetermined schedule to achieve optimum forming speed and quality.

9. A gas management system as defined in claim 8, further comprising:

a cross channel conduit and a control valve in said conduit to equalize the pressure on both sides of said blank when said control valve is open.

10. A gas management system as defined in claim 8, further comprising:

a differential pressure transducer coupled between said two channels for sensing a pressure differential between said two channels, and a differential pressure controller for controlling the differential pressure therebetween.

11. A gas management system as defined in claim 10, wherein:

said differential pressure controller is one and the same with said pressure controller.

12. A process for forming sheet metal parts by superplastic forming in a forming cycle, comprising:

inserting a sheet of superplastic metal in a die between a die lid and a die base having a die base cavity;

clamping said sheet between said die lid and said die base to create a sealed compartment between a top surface of said sheet and an inner surface of said die lid, and a die base cavity between an underside of said sheet and an upper surface of said die base:

heating said sheet to a temperature at which said sheet exhibits superplastic characteristics;

injecting gas under pressure into said compartment between said die lid and said sheet of superplastic material to cause said sheet to deform into said die base cavity;

measuring gas flow out of said die base cavity as said gas in said die base cavity is displaced by said sheet metal as said sheet metal deforms into said cavity;

adjusting said pressure of said gas injection into said compartment to produce a gas mass flow rate from said die base cavity on a predetermined schedule of mass flow increase ramp, constant mass flow period, and mass flow decrease ramp;

whereby said displaced gas mass flow rate schedule is preestablished to account for low initial gas flow rates near a beginning period of said forming cycle, high gas mass flow rates in a central portion of said forming cycle, and low gas mass flow rates near an end portion of said forming cycle so that said forming rate of said sheet is optimized throughout said forming cycle.

13. A process as defined in claim 12, further comprising:

establishing a maximum forming gas pressure limit and constraining said forming gas pressure below said maximum forming gas pressure limit;

whereby said forming gas pressure is limited to below a predetermined maximum regardless of the displaced gas mass flow rate out of said die.

14. A process for superplastic forming of sheet metal raised to superplastic temperature using gas pressure over said sheet to form said sheet into a die at an accurately controlled optimum forming rate, comprising:

measuring instantaneous gas mass flow displaced out of said die by said sheet metal forming into said die;

converting said gas mass flow measurements into a signal;

averaging said signals within predetermined time periods to produce a conditioned signal;

conducting said conditioned signals to a gas flow control unit;

controlling said forming gas flow to cause said displaced gas mass flow from said die to approximate a predetermined ramp and holding time schedule to optimize said metal forming rate;

whereby said forming gas pressure is controlled in accordance with a predetermined relationship between said ramping rates and holding times, and said mass flow rate of said gas displaced out of said die by said forming sheet metal.

15. A process as set forth in claim 14, further comprising:

establishing a maximum forming gas pressure limit and constraining said forming gas pressure below said maximum forming gas pressure limit;

whereby said forming gas pressure is limited to below a predetermined maximum regardless of the displaced gas mass flow rate out of said die.

16. A gas management system for a superplastic forming machine for forming sheet metal at superplastic forming temperatures into a die base using gas pressure injected into a die lid compartment between said sheet metal and a die lid clamping said sheet metal to said die base, comprising:

a source coupling for connecting a source of high pressure inert gas to said system, and a die lid coupling for connecting said system to said die lid for injecting forming gas into said die lid compartment;

an inlet piping network connected between said source coupling and said die lid coupling;

an outlet piping network connected between a die base coupling and the atmosphere;

a pressure control system in said inlet piping network for highly accurate control of gas pressure delivered by said inlet piping network to said die lid coupling;

said pressure control including a pressure regulator system for reducing said gas pressure in said inlet piping network from a high pressure to said set pressure;

said pressure regulator system reducing said gas pressure by a variable amount in accordance with signals received from said pressure control;

a gas mass flow sensor in said outlet piping network for measuring instantaneous gas mass flow rates out of said die base;

an averaging circuit in said pressure control system for averaging said instantaneous pressure measurements in predetermined time periods;

a memory circuit for recording a predetermined schedule of gas mass outflow rates to be maintained out through said outlet piping network;

said pressure control system maintaining said gas mass outflow rate at said predetermined schedule through said gas mass flow sensor by controlling said pressure regulator system to produce a forming gas pressure in said die lid compartment that forms said sheet at a rate that displaces gas from said die base cavity at said predetermined schedule.

17. A gas management system as defined in claim 16, wherein:

said pressure control includes a PID control unit having an input connection from said a gas mass flow sensor and a input to receive a pressure maximum limit above below said PID control unit limits said forming gas pressure admitted into said die lid compartment by said pressure regulator system.

* * * * *